US005676200A

United States Patent [19]

Laveran

[11] Patent Number: 5,676,200

[45] Date of Patent: Oct. 14, 1997

[54] HEAT EXCHANGER, IN PARTICULAR A BOOSTER AIR RADIATOR FOR A MOTOR VEHICLE

[75] Inventor: Jean Louis Laveran, Asnieres S/Seine, France

[73] Assignee: Valeo Thermique Moteur, Le Mesnil-Saint-Denis, France

[21] Appl. No.: 720,778

[22] Filed: Oct. 3, 1996

[30] Foreign Application Priority Data

Oct. 6, 1995 [FR] France ..... 95 11818

[51] Int. Cl.[6] ..... F28F 9/02

[52] U.S. Cl. ..... 165/83; 165/173; 165/DIG. 51

[58] Field of Search ..... 165/82, 83, 173

[56] References Cited

U.S. PATENT DOCUMENTS

| | | | |
|---|---|---|---|
| 352,380 | 11/1886 | Warden | 165/83 X |
| 2,807,445 | 9/1957 | Gardner | 165/173 |
| 4,226,280 | 10/1980 | De Cenival et al. | 165/69 |
| 4,582,127 | 4/1986 | Moranne . | |
| 4,881,594 | 11/1989 | Beamer et al. | 165/173 |

FOREIGN PATENT DOCUMENTS

| | | | |
|---|---|---|---|
| 0 114 554 | 1/1984 | European Pat. Off. . | |
| 859745 | 10/1952 | Germany | 165/83 |
| 26 39 693 | 9/1978 | Germany . | |
| 620794 | 8/1978 | U.S.S.R. | 165/83 |
| 845794 | 8/1960 | United Kingdom . | |

*Primary Examiner*—Allen J. Flanigan

*Attorney, Agent, or Firm*—Morgan & Finnegan, L.L.P.

[57] ABSTRACT

The heat exchanger of the invention comprises a header plate which has a wall in which there are holes suitable for receiving the ends of tubes in a bank, the wall of the header plate forming collars around holes and having a localised thinning (A) in a chosen area surrounding each collar to allow an axial movement of the collar with respect to the rest of the header plate under the effect of variations in the length of the tube arising from differences in thermal expansion. Application notably to exchangers for booster air for turbo-charged engines in motor vehicles.

8 Claims, 2 Drawing Sheets

HEAT EXCHANGER, IN PARTICULAR A BOOSTER AIR RADIATOR FOR A MOTOR VEHICLE

FIELD OF THE INVENTION

The invention concerns a heat exchanger in the form of a booster air radiator for a motor vehicle and more particularly a heat exchanger comprising a header plate which has a wall in which there are holes suitable for receiving the ends of tubes in a bank, the wall of the header plate being configured in such a way as to form collars around holes for the purpose of a connection with the tubes by brazing.

BACKGROUND OF THE INVENTION

In heat exchangers of this type, the header plate is topped by a header box so as to provide a chamber suitable for having passing through it a fluid which also circulates in the tubes in the bank.

Normally, two header boxes are provided respectively at the two ends of the bank of tubes.

For certain types of heat exchanger, notably in the case of booster air radiators, the tubes have passing through them a fluid which can be subject to large temperature differences, which lead to major differences in expansion.

These differences in expansion can cause stresses at the connection by brazing between the ends of the tubes and the header plate. These stresses can even cause rupture of the connection, and thus a risk of leakage.

The invention aims notably to overcome this drawback.

DISCUSSION OF THE INVENTION

It therefore proposes a heat exchanger comprising a header plate which has a wall in which there are holes suitable for receiving the ends of tubes in a bank, the wall of the header plate being configured in such a way as to form collars around holes for the purpose of a connection with the tubes by brazing wherein the wall of the header plate has a localised thinning in a chosen area surrounding each collar to allow an axial movement of the collar with respect to the rest of the header plate under the effect of variations in the length of the tube arising from differences in thermal expansion.

Thus the collar is connected to the rest of the header plate by an area in which the wall of the header plate is made thinner, which permits a deformation of the wall and, consequently, an axial movement of the collar.

As a result, the collar follows the movement of the end of the tube according to the differences in thermal expansion.

Consequently, the brazing is no longer subjected to stresses and there is no longer a risk of causing leakages at the connection between the collar and the end of the tube.

According to another characteristic of the invention, this localised thinning is produced in an annular area which has a shape similar to that of the collar.

Each collar is advantageously attached to the rest of the header plate by an annular fold which has a substantially U-shaped cross section and which has one arm which constitutes the collar and another arm which constitutes a fixing arm. In such a case, this localised thinning is produced in this fixing arm.

According to another characteristic of the invention, this localised thinning is produced by stamping or the removal of material, either on a face of the wall of the header plate or on both faces of the wall of the header plate.

The invention applies in particular to a heat exchanger in which the header plate and the tubes are made of aluminium.

In one embodiment of the invention, in which the collar has an elongate shape suitable for receiving a flat tube, the localised thinning is produced in an area which is elongate in shape, similar to the collar.

The heat exchanger of the invention is particularly easy to produce in the form of a booster air radiator designed to cool a flow of air supplying a turbocharged engine.

BRIEF DESCRIPTION OF THE INVENTION

In the description which follows, given solely by way of example, reference is made to the accompanying drawings, in which.

DESCRIPTION OF THE PREFERRED EMBODIMENT

Figure 1:
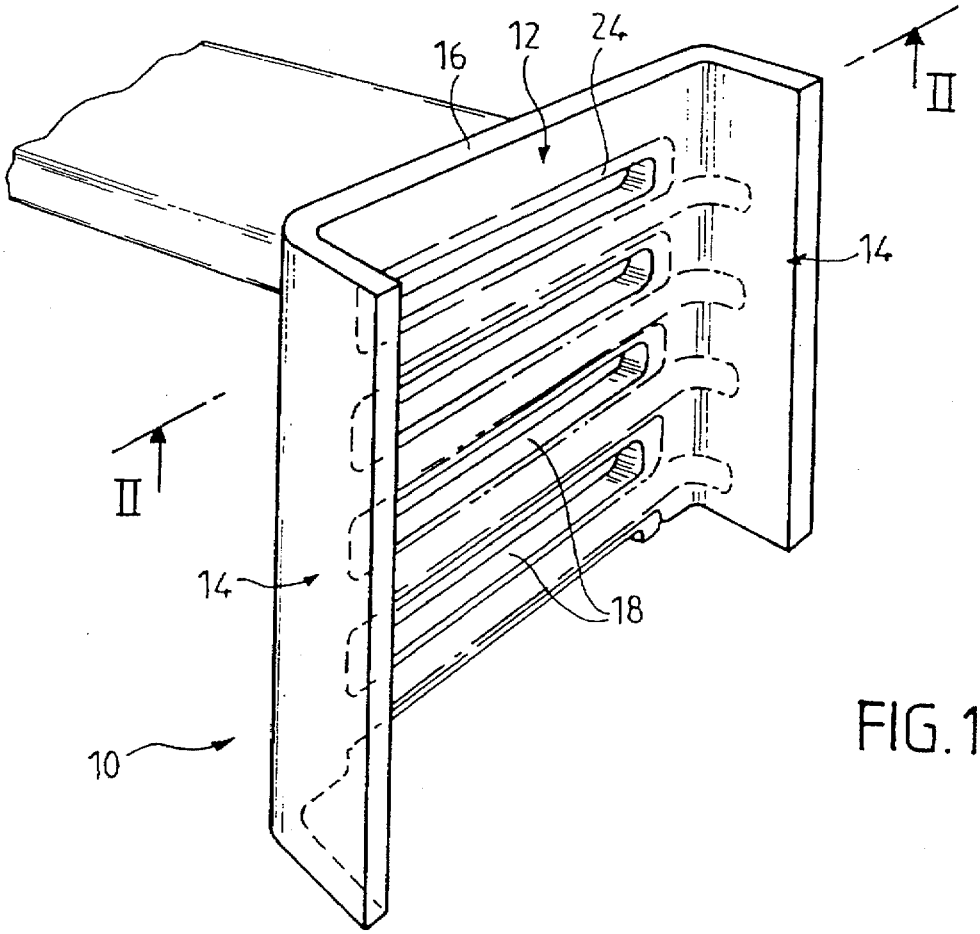
FIG. 1 is a partial perspective view of a heat exchanger according to the invention.
Figure 2:
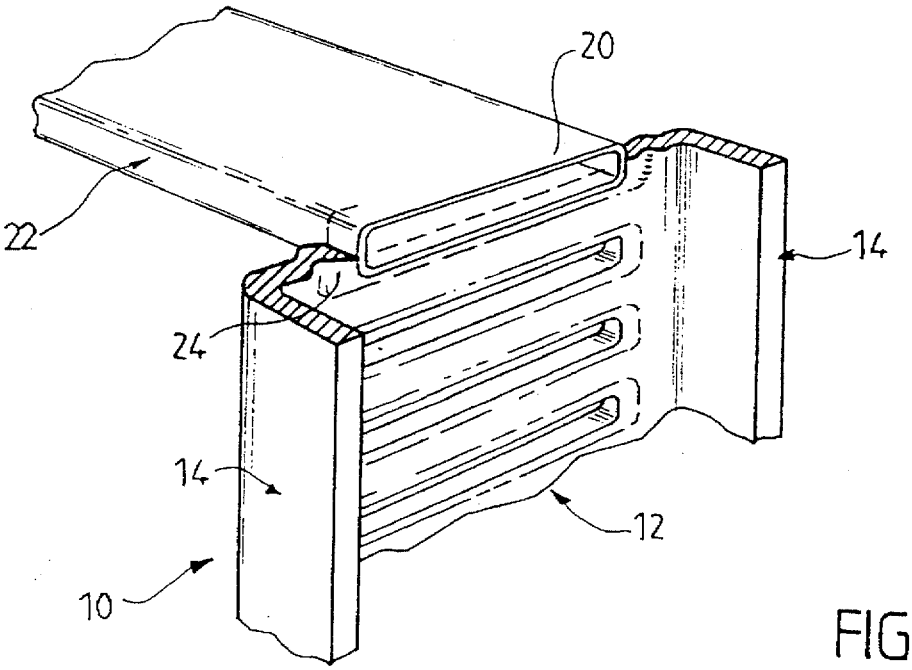
FIG. 2 is a view similar to that in FIG. 1, with a cross section along the line II—II in FIG. 1.

The heat exchanger depicted in FIGS. 1 and 2 comprises a header plate 10 which has a web 12 of rectangular shape overall provided with two longitudinal edges 14 folded substantially at a right angle, to allow the header plate 10 to be capped by a header box wall (not shown) and define a chamber suitable for having a fluid pass through it.

The header plate 10 has a metal wall 16, for example made of aluminium, which is pressed to form the web 12 and the longitudinal edges 14.

Furthermore, in the web 12 are formed a plurality of holes 18 which, in the example, have a substantially rectangular oblong shape whose length extends transversely to the web 12, that is to say perpendicular to the longitudinal edges 14.

The holes 18 are disposed in a single row and regularly spaced.

Each hole 18 is suitable for receiving one end 20 of a tube 22, in the example a "flat tube", which has an external cross section adapted to that of the internal cross section of the hole 18.

The tubes 22 are made of metal, for example aluminium, and their ends 20 are designed to be connected by brazing to the wall 16 of the header plate 10.

In order to facilitate this connection, each hole is bordered by a collar 24 obtained by deforming the wall 16. This collar extends over an axial length greater than the thickness of the wall 16 to afford an improved connection by brazing between the end of the tube and the header plate.

In the example in which this heat exchanger is used as a booster air radiator, the tubes 22 have passing through them a flow of air which can be subjected to major temperature variations, leading to variations in the expansion of the tube which can cause stress in the connection by brazing between the end of the tube and the corresponding collar.

To avoid this drawback, the invention provides means of affording a movement of the collar with respect to the web 12 of the header plate.

Figure 3:
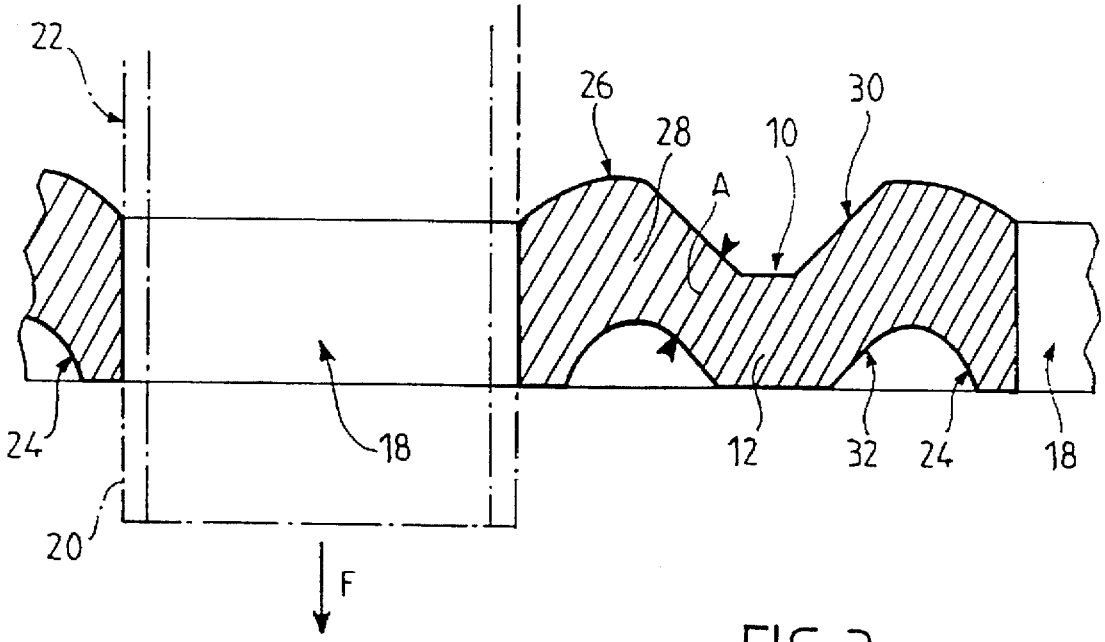
FIG. 3 is a partial cross section view of a header plate in a first embodiment.

In the embodiment in FIG. 3, to which reference is now made, each collar 24 is attached to the web 12, that is to say to the rest of the header plate 10, by an annular fold 26 which has a contour similar to that of the collar and which is, in cross section, substantially U-shaped.

This U has a first arm which forms the collar and another arm 28 which forms an arm for connection to the web 12. This arm 28 has a localised thinning A at which the thickness of the wall of the plate is lower than at the web 12.

In the embodiment in FIG. 3, this localised thinning is obtained by stamping or the removal of material from the external face 30 of the header plate 10, while its internal face 32 has not had material removed from it.

Figure 4:
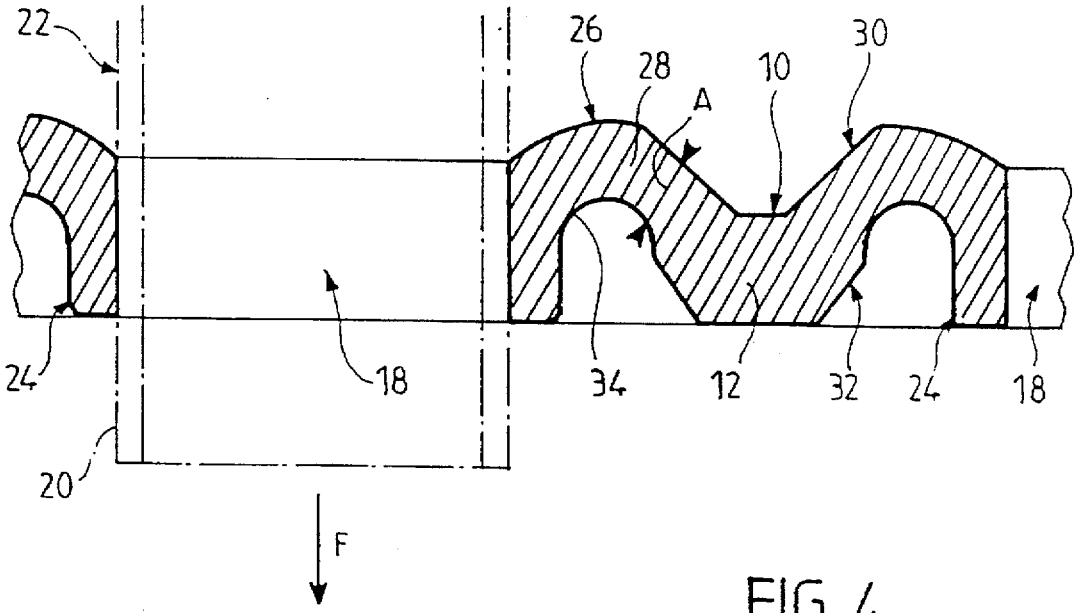
FIG. 4 is a partial cross section view of a header plate according to another embodiment.

In the embodiment in FIG. 4, to which reference is now made, the configuration of the header plate is substantially identical to that in FIG. 3.

The only difference lies in the fact that the thinning A is thinner.

This arises from the fact that an additional removal of material has been performed from the internal face 32, as shown by an annular groove 34 which surrounds the collar 24.

In one or other of the preceding embodiments, if the tube 22 expands in the direction of its length, the collar 24 can move, in the direction of the arrow F, with respect to the web 12 by virtue of the thinning A produced in the thickness of the wall and in an annular area surrounding the collar.

As a result, the brazed connection (not shown) between the end 20 of the tube and the collar 24 will not be subjected to any stresses liable to cause cracking or rupturing of the brazing.

Of course, the invention is not limited to the embodiment described previously by way of example.

It applies in particular to other types of heat exchanger having tubes with different cross sections and able to be used in applications other than booster air radiators.

What is claimed is:

1. A heat exchanger of the type comprising a metal header plate which has a wall in which there are holes suitable for receiving the ends of tubes in a bank, the wall of the header plate being configured in such a way as to form collars around holes for the purpose of a connection with the tubes by brazing, wherein the wall of the header plate has a localised thinning (A) in a chosen area surrounding each collar to allow an axial movement of the collar with respect to the rest of the header plate under the effect of variations in the length of the tube arising from differences in thermal expansion.

2. The heat exchanger of claim 1, wherein localised thinning (A) is produced in an annular area which has a shape similar to that of the collar.

3. The heat exchanger of claim 1, in which each collar is attached to the rest of the header plate by an annular fold which has a substantially U-shaped cross section having one arm which constitutes the collar and another arm which constitutes a fixing arm, and wherein the localised thinning (A) is produced in this fixing arm.

4. The heat exchanger of claim 1, wherein the localised thinning (A) is produced by stamping or the removal of material on a face of the wall of the header plate.

5. The heat exchanger of claim 1, wherein the localised thinning (A) is produced by stamping or the removal of material on both faces of the header plate.

6. The heat exchanger of claim 1, wherein the header plate and the tubes are made of aluminium.

7. The heat exchanger of claim 1, in which each collar has an elongate shape suitable for receiving a flat tube, wherein the localised thinning is produced in an area which has an elongate shape, similar to that of the collar.

8. The heat exchanger of claim 1 forming a booster air radiator.

* * * * *